US006065572A

United States Patent [19]

Schober et al.

[11] Patent Number: 6,065,572

[45] **Date of Patent: *May 23, 2000**

[54] POLYMERIC MATERIALS TO SELF-REGULATE THE LEVEL OF POLAR ACTIVATORS IN ELECTRORHEOLOGICAL FLUIDS

[75] Inventors: Barton J. Schober, Perry; Joseph W. Pialet, Euclid; Robert A. Pollack, Highland Heights; Denise R. Clark, Perry, all of Ohio

[73] Assignee: The Lubrizol Corporation, Wickliffe, Ohio

[ * ] Notice: This patent is subject to a terminal disclaimer.

[21] Appl. No.: 09/085,563

[22] Filed: May 27, 1998

Related U.S. Application Data

[63] Continuation-in-part of application No. 08/556,344, Nov. 13, 1995.

[51] Int. Cl.[7] ..... F16F 15/03; H01B 3/20; C09K 5/00

[52] U.S. Cl. ..... 188/267; 252/572; 252/73; 252/77; 252/75

[58] Field of Search ..... 188/267, 267.1, 188/267.2; 252/572, 73, 77, 74, 75

[56] References Cited

U.S. PATENT DOCUMENTS

| | | | |
|---|---|---|---|
| 2,948,691 | 8/1960 | Windemuth et al. | 260/2.5 |
| 4,102,716 | 7/1978 | Groves et al. | 156/48 |
| 4,732,930 | 3/1988 | Tanaka et al. | 524/742 |
| 4,990,279 | 2/1991 | Ahmed | 252/73 |
| 5,100,933 | 3/1992 | Tanaka et al. | 523/300 |
| 5,242,491 | 9/1993 | Mamada et al. | 106/241 |
| 5,259,487 | 11/1993 | Petek | 188/315 |
| 5,266,229 | 11/1993 | Tomizawa et al. | 252/73 |
| 5,268,118 | 12/1993 | Bloodworth et al. | 252/73 |
| 5,308,525 | 5/1994 | Koboyashi et al. | 252/78.3 |
| 5,364,565 | 11/1994 | Li | 252/512 |
| 5,396,973 | 3/1995 | Schwemmer et al. | 188/299 |
| 5,403,893 | 4/1995 | Tanaka et al. | 525/218 |
| 5,412,006 | 5/1995 | Fisher et al. | 524/47 |
| 5,489,009 | 2/1996 | Kawamata et al. | 188/267 |
| 5,496,483 | 3/1996 | Herrmann et al. | 252/73 |
| 5,501,809 | 3/1996 | Schober et al. | 252/73 |
| 5,505,871 | 4/1996 | Harder et al. | 252/78.3 |
| 5,762,584 | 6/1998 | Daniels | 482/75 |
| 5,843,331 | 12/1998 | Schober et al. | 252/77 |

FOREIGN PATENT DOCUMENTS

| | | |
|---|---|---|
| 0432601 | 6/1991 | European Pat. Off. . |
| 0529166 | 3/1993 | European Pat. Off. . |
| 47-17674 | of 1972 | Japan . |
| 1-253110 | 10/1989 | Japan . |
| 2-169695 | 6/1990 | Japan . |
| 335095 | 2/1991 | Japan . |
| 5-271679 | 10/1993 | Japan . |
| 6220476 | 8/1994 | Japan . |
| 6220481 | 8/1994 | Japan . |
| 8-3577 | 1/1996 | Japan . |
| 9222623 | 12/1992 | WIPO . |
| 9314180 | 7/1993 | WIPO . |

OTHER PUBLICATIONS

Bloodworth et al, "ER fluids based on polyurethane dispersions", Chem Abs 123:230495, 1994*.

Uemura et al, "Novel electro–responsive property of polyether–polycarbamate solution", Chem Abs 122:11135, 1994*.

*Primary Examiner*—Robert J. Oberleitner
*Assistant Examiner*—Jeffrey Woller
*Attorney, Agent, or Firm*—David M. Shold

[57] ABSTRACT

Electrorheological systems of improved temperature range are obtained by including within the system a solid polymer insoluble in a low molecular weight activating material and in the hydrophobic medium of the fluid. The polymer contains hydrophilic functionality, and in the polymer a portion of the low molecular weight polar activating material is sorbed in an amount which reversibly increases with increasing temperature.

20 Claims, 2 Drawing Sheets

POLYMERIC MATERIALS TO SELF-REGULATE THE LEVEL OF POLAR ACTIVATORS IN ELECTRORHEOLOGICAL FLUIDS

This is a continuation-in-part of copending application Ser. No. 08/556,344 filed Nov. 13, 1995.

BACKGROUND OF THE INVENTION

The present invention relates to electrorheological fluids, systems, and devices, in which the fluid contains a polar liquid activator. The distribution of the activator is modified by means of sorption in a solid polymer.

Electrorheological ("ER") fluids are fluids which can rapidly and reversibly vary their apparent viscosity in the presence of an applied electric field. ER fluids are generally dispersions of finely divided solids in hydrophobic, electrically non-conducting oils. They have the ability to change their flow characteristics, even to the point of becoming solid, when subjected to a sufficiently strong electrical field. When the field is removed, the fluids revert to their normal liquid state. ER fluids may be used in applications in which it is desired to control the transmission of forces by low electric power levels, for example, in clutches, hydraulic valves, shock absorbers, vibrators, or systems used for positioning and holding work pieces in position.

Numerous types of electrorheological fluids are known, many of which require water or some other polar activating liquid in order to exhibit significant activity. For example, PCT application WO93/14180, published Jul. 22, 1993, discloses an electrorheological fluid comprising a hydrophobic liquid phase, cellulosic particles as a dispersed phase and a functionalized polysiloxane. The fluid can further contain an organic polar compound, other than the material of the hydrophobic liquid phase.

European publication EP 0 432 601 A1, Herrmann et al., Jun. 19, 1991, discloses electroviscous fluids based on dispersed polyethers. The invention relates to electroviscous fluids, consisting essentially of (a) a linear and/or branched, optionally functionalized polyether or its monomer, the reaction product of such a polyether or monomer with mono-or oligofunctional compounds and, optionally further additional additives; (b) dispersing agents, and also (c) a nonaqueous dispersion medium. The dispersion medium can be silicone oil. The dispersed phase can be polyethylene glycol or trifunctional polyethylene glycol. The dispersing agent can be an $\alpha,\omega$-polyetherpolydimethyl siloxane copolymer. A crosslinking agent can be toluene diisocyanate or triacetoxymethylsilane. In a typical form of preparation of the EVF of the invention, the material that is to be introduced is mixed with the reactive additive or the crosslinking material. After homogenizing the components, the mixture is dispersed in a fluid phase containing the dispersant.

In another field of technology, certain polymeric gels are known to be able to reversibly absorb fluids under various conditions. For example, U.S. Pat. No. 5,100,933, Tanaka et al., Mar. 31, 1992, discloses collapsible gel compositions of ionized crosslinked polyacrylamide gels. They are capable of drastic volume changes in response to minor changes in solvent concentration, temperature, pH, or salt concentration of the solvent.

SUMMARY OF THE INVENTION

The present invention provides an electrorheological fluid system comprising:

(a) a hydrophobic liquid medium having a boiling point of at least about 150° C.;

(b) a dispersed particulate phase comprising particles which are capable of exhibiting electrorheological activity in the presence of an activating material, in an amount suitable to provide electrorheological activity;

(c) a low molecular weight polar activating material in an amount suitable to modify the electrorheological activity of said dispersed particulate phase; and (d) a solid polymer, distinct from the particles of (b), insoluble in said low molecular weight activating material and in said hydrophobic medium, containing hydrophilic functionality, said polymer being capable of sorbing an amount of said low molecular weight polar activating material which increases with increasing temperature, said sorption being at least in part reversible.

The present invention further provides an electrorheological device which comprises a fluid compartment which contains the above-described fluid system and a pair of electrodes encompassing a portion of said fluid system.

Further provided is a method for reducing the effect of temperature on the electrical properties of an electrorheological fluid which contains dispersed particles activated by a low molecular weight polar activating material, comprising including within said electrorheological fluid a solid polymer, insoluble in the electrorheological fluid and distinct from the dispersed particles, which contains hydrophilic functionality, said polymer being capable of sorbing an amount of said low molecular weight polar activating material which increases with increasing temperature, said sorption being at least in part reversible.

The present invention additionally provides a method for increasing the apparent viscosity of the electrorheological fluid system of the above electrorheological fluid system, comprising applying an electric field to said system.

DETAILED DESCRIPTION OF THE INVENTION

Figure 1:
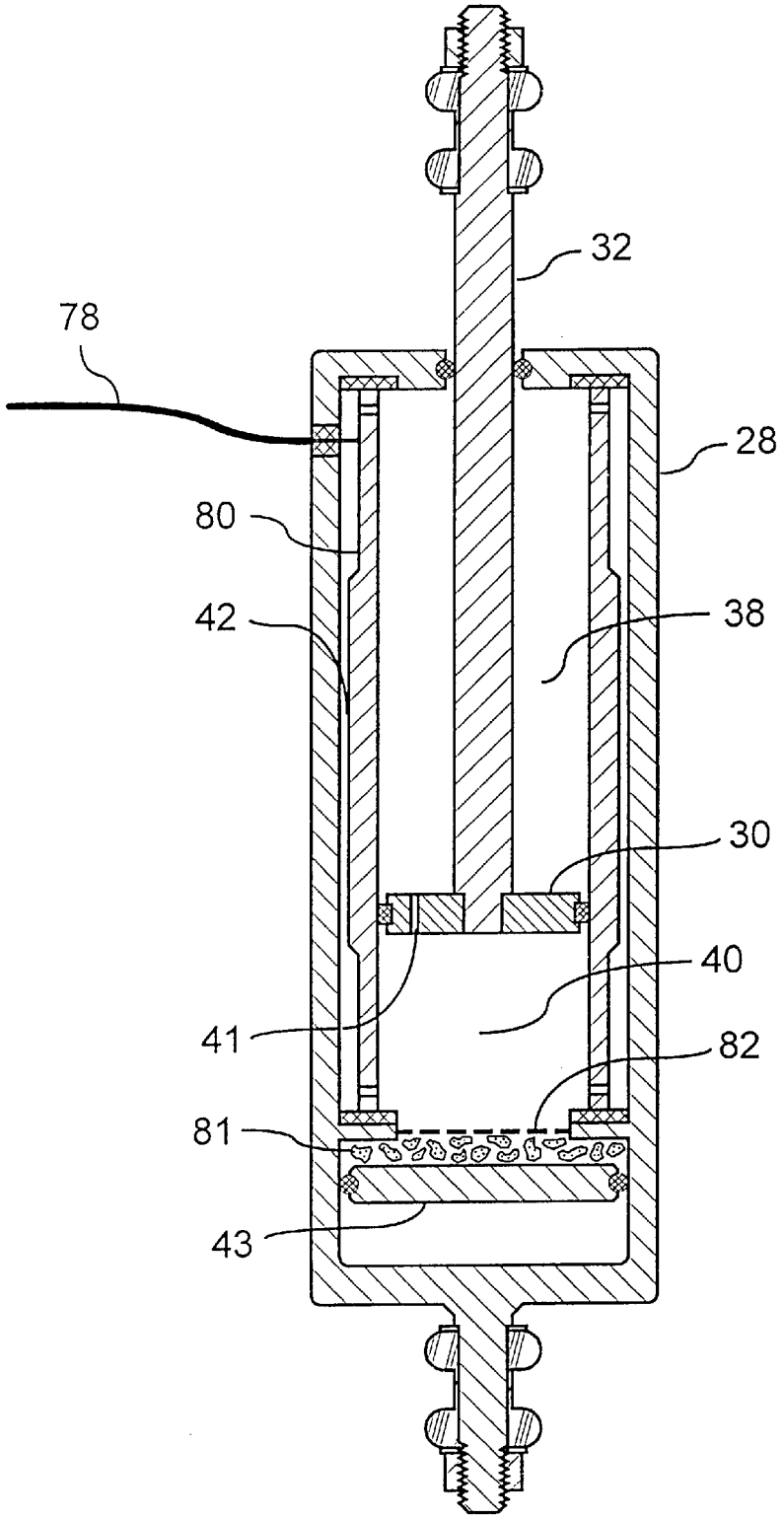
FIG. 1 illustrates one embodiment of the system of the present invention, in the form of a damper.

The first component of the present electrorheological fluids is a hydrophobic liquid phase, which is a non-conducting, electrically insulating liquid or liquid mixture. Examples of insulating liquids include silicone oils, transformer oils, mineral oils, vegetable oils, aromatic oils, paraffin hydrocarbons, naphthalene hydrocarbons, olefin hydrocarbons, chlorinated paraffins, synthetic esters, hydrogenated olefin oligomers, hydrocarbon oils generally, and mixtures thereof. The choice of the hydrophobic liquid phase will depend largely on practical considerations including compatibility of the liquid with other components of the system, solubility of certain components therein, and the intended utility of the ER fluid. For example, if the ER fluid is to be in contact with elastomeric materials, the hydrophobic liquid phase should not contain oils or solvents which affect those materials. Similarly, the liquid phase should be selected to have suitable stability over the intended temperature range, which in the case of the present invention will extend to 120° C. or even higher. Furthermore, the fluid should have a suitably low viscosity in the absence of a field that sufficiently large amounts of the dispersed phase can be incorporated into the fluid. Suitable liquids include those which have a viscosity at room temperature of 1 to 300 or 500 centistokes, or preferably 2 to 20 or 50 centistokes. Mixtures of two or more different non-conducting liquids can be used for the liquid phase. Mixtures can be selected to provide the desired density, viscosity, pour point, chemical and thermal stability, component solubility, etc.

Useful liquids generally have as many of the following properties as possible: (a) high boiling point and low freezing point; (b) low viscosity so that the ER fluid has a low no-field viscosity and so that greater proportions of the solid dispersed phase can be included in the fluid; (c) high electrical resistance and high dielectric breakdown potential, so that the fluid will draw little current and can be used over a wide range of applied electric field strengths; and (d) chemical and thermal stability, to prevent degradation on storage and service. Moreover, useful liquids will be selected such that they dissolve neither the electrorheologically active particles nor the solid polymer (d), both described below. It is preferred that the liquids will, similarly, not interact to signficantly swell the electrorheologically active particles or the solid polymer (d), and preferably will not swell such materials to any appreciable extent at all.

One class of insulating liquids comprises esters of dicarboxylic acids (e.g., phthalic acid, succinic acid, alkyl succinic acids and alkenyl succinic acids, maleic acid, azelaic acid, suberic acid, sebasic acid, fumaric acid, adipic acid, linoleic acid dimer, malonic acid, alkylmalonic acids, alkenyl malonic acids) with a variety of alcohols and polyols (e.g., butyl alcohol, hexyl alcohol, dodecyl alcohol, 2-ethylhexyl alcohol, ethylene glycol, diethylene glycol, monoether, propylene glycol). Specific examples of these esters include dibutyl adipate, di(2-ethylhexyl)sebacate, di-n-hexyl fumarate, dioctyl sebacate, diisooctyl azelate, diisodecyl azelate, dioctyl phthalate, didecyl phthalate, dieicosyl sebacate, the 2-ethylhexyl diester of linoleic acid dimer, and the complex ester formed by reacting one mole of sebacic acid with two moles of tetraethylene glycol and two moles of 2-ethylhexanoic acid. By way of example, one of the suitable esters is di-isodecyl azelate, available under the name Emery™ 2960.

Esters useful as insulating liquids also include those made from $C_5$ to $C_{18}$ monocarboxylic acids and alcohols, polyols, and polyol ethers such as isodecyl alcohol, neopentyl glycol, trimethylolpropane, pentaerythritol, dipentaerythritol and tripentaerythritol.

Polyalpha olefins and hydrogenated pollyanna olefins (referred to in the art as PAOs) are useful in the ER fluids of the invention. PAOs are derived from alpha olefins containing from 2 to about 24 or more carbon atoms such as ethylene, propylene, 1-butene, isobutene, 1-decene, etc. Specific examples include polyisobutylene having a number average molecular weight of 650; a hydrogenated oligomer of 1-decene having a viscosity at 100° C. of 8 cSt; ethylene-propylene copolymers; etc. An example of a commercially available hydrogenated pollyanna olefin is Emery™ 3004.

Silicon-based oils such as the polyalkyl-, polyaryl-, polyalkoxy-, or polyaryloxysiloxane oils and silicate oils comprise a particularly useful class of insulating liquids. These oils include tetraethyl silicate, tetraisopropyl silicate, tetra-(2-ethylhexyl)silicate, tetra-(4-methyl-2-ethylhexyl) silicate, tetra-(p-terbutylphenyl)silicate, hexa-(4-methyl-2-pentoxy)disiloxane, poly(methyl)siloxanes, including poly (dimethyl)siloxanes, and poly(methylphenyl)siloxanes. The silicone oils are useful particularly in ER fluids which are to be in contact with elastomers.

Among the suitable vegetable oils for use as the hydrophobic liquid phase are sunflower oils, including high oleic sunflower oil available under the name Trisun™ 80, rapeseed oil, and soybean oil. Examples of other suitable materials for the hydrophobic liquid phase are set forth in detail in PCT publication WO93/14180, published Jul. 22, 1993. The selection of these or other fluids will be apparent to those skilled in the art.

Another class of insulating liquids includes alkylene oxide polymers and interpolymers and derivatives thereof where the terminal hydroxyl groups have been modified by esterification, etherification, etc., constitute a class of insulating liquids. These are exemplified by polyoxyalkylene polymers prepared by polymerization of ethylene oxide or propylene oxide, the alkyl and aryl ethers of these polyoxyalkylene polymers (e.g., methyl-poly isopropylene glycol ether having an average molecular weight of 1000, diphenyl ether of poly-ethylene glycol having a molecular weight of 500–1000, diethyl ether of polypropylene glycol having a molecular weight of 1000–1500); and mono- and polycarboxylic esters thereof, for example, the acetic acid esters, mixed $C_3$–$C_8$ fatty acid esters and $C_{13}$ Oxo acid diester of tetraethylene glycol.

The second component of the present electrorheological fluids is a dispersed particulate phase. The broad category of dispersed particulate phase includes both those materials which are believed to require a low molecular weight polar material for their ER activity as well as those which exhibit such activity even in the absence of a low molecular weight polar material. Many ER active solids are known, and any of these, as well as their equivalents, are considered to be suitable for use in the ER fluids of the present invention, although those particles whose activity can be modified by a low molecular weight polar material are preferred. Among the preferred particles are polymeric materials.

One preferred class of ER active solids suitable for use as this portion of the dispersed phase includes carbohydrate based particles and related materials such as starch, flour, monosaccharides, and preferably cellulosic materials. The term "cellulosic materials" includes cellulose as well as derivatives of cellulose such as microcrystalline cellulose. Microcrystalline cellulose is the insoluble residue obtained from the chemical decomposition of natural or regenerated cellulose. Crystallite zones appear in regenerated, mercerized, and alkalized celluloses, differing from those found in native cellulose. By applying a controlled chemical pretreatment to destroy molecular bonds holding these crystallites, followed by mechanical treatment to disperse the crystallites in aqueous phase, smooth colloidal microcrystalline cellulose gels with commercially important functional and rheological properties can be produced. Microcrystalline cellulose can be obtained from FMC Corp. under the name Lattice™ NT-013. Other sources of cellulose are also useful in the present invention; examples include CF1, CF11, and CC31, available from Whatman Specialty Products Division of Whatman Paper Limited, and amorphous Solka-Floc™, available from Fiber Sales & Development Corp. Other cellulose derivatives include ethers and esters of cellulose, including methyl cellulose, ethyl cellulose, hydroxyethyl cellulose, hydroxypropyl cellulose, cellulose nitrates, sodium carboxymethyl cellulose, cellulose propionate, cellulose butyrate, cellulose valerate, and cellulose triacetate. Other cellulose derivatives include cellulose phosphates and cellulose reacted with various amine compounds. Other cellulosic materials include chitin, chitosan, chondroiton sulfate, certain natural gums such as xanthan gum, and viscose or cellulose xanthate. Cellulosic materials, and in particular cellulose, are preferred materials for the present invention. A more detailed listing of suitable cellulosics is set forth in PCT publication WO93/14180.

In another embodiment, the ER active solid particles are or can include particles of organic semiconductive polymers, polarizable polymers, or polyelectrolytes, such as oxidized or pyrolyzed polyacrylonitrile, polyacene quinones, polypyrroles, polyphenylenes, polyphenylene oxides, polyphenylene sulfides, polyacetylenes, polyphenothiazines, polyimidazoles, and preferably polyaniline, substituted polyanilines, and aniline copolymers. Compositions of the above and related materials, treated or doped with various additives including acids, bases, metals, halogens, sulfur, sulfur halides, sulfur oxide, and hydrocarbyl halides can also be employed. A more detailed description of certain of these materials be found in PCT publications WO93/07243 and WO93/07244, both published Apr. 15, 1993. A preferred organic polymeric semiconductor is polyaniline, particularly the polyaniline prepared by polymerizing aniline in the presence of an oxidizing agent (such as a metal or ammonium persulfate) and 0.1 to 1.6 moles of an acid per mole of aniline, to form an acid salt of polyaniline. The polyaniline salt is thereafter treated with a base to remove some or substantially all of the protons derived from the acid. A more complete description of polyaniline and its preferred method of preparation is set forth in PCT publication WO93/07244, published Apr. 15, 1993. The aniline polymer can be the homopolymer or any of a number of copolymers or modified polymers such as a sulfonated aniline/o-toluidine copolymer.

Inorganic materials which can be suitably used as ER active particles include semiconductors (based on silicon, germanium, and so on), chromic oxide, germanium sulfide, ceramics, copper sulfide, carbon particles, silica gel, magnesium silicate, alumina, silica-alumina, pyrogenic silica, zeolites, and the like. These can be in the form of solid particles or, in certain cases, hollow microspheres, the latter being available from, i.a., PQ Corporation of Valley Forge, Pa. Microspheres include hollow ceramic microspheres, 10–100 mm, containing up to 5% crystalline silica (Extendospheres™ SF-14) and silver-coated ceramic microspheres, 10–75 mm (Metalite™ Silver SF-20)

Another class of suitable ER active solid particles is that of polymeric salts, including silicone-based ionomers (e.g. the ionomer from amine functionalized diorganopolysiloxane plus acid), metal thiocyanate complexes with polymers such as polyethylene oxide, and carbon based ionomeric polymers including salts of ethylene/acrylic or methacrylic acid copolymers or phenolformaldehyde polymers. One preferred polymer comprises an alkenyl substituted aromatic comonomer, a maleic acid comonomer or derivative thereof, and optionally additional comonomers, wherein the polymer contains acid functionality which is at least partly in the form of a salt. Preferably in such materials the maleic acid comonomer is a salt of maleic acid in which the maleic acid comonomer is treated with 0.5 to 2 equivalents of base. Preferably this material is a 1:1 molar alternating copolymer of styrene and maleic acid, the maleic acid being partially in the form of the sodium salt. This material is described in more detail in PCT publication WO93/22409, published Nov. 11, 1993.

Another category of material which can exhibit electrorheological activity is the class of ferroelectric materials. These are materials which exhibit the property of ferroelectricity, which may be seen as an electric analogue of ferromagnetism, that is, in which certain crystals may exhibit a spontaneous dipole moment. The most typical of such materials is barium titanate; others include monobasic potassium phosphate and potassium-sodium tartrate ("Rochelle salts"). Ferroelectric materials have been classified as ferroelectric tartrates, di-hydrogen phosphates and arsenates, the "oxygen-octahedra group" which includes tantalates, niobates, tungstates, and perovskites, and the guanidine compounds. Ferroelectrics and ferroelectricity are described in greater detail in "The Encyclopedic Dictionary of Physics," Pergamon Press, 1961, New York, Vol. 3, pages 94–97.

Other materials which can be used as ER active solid particles include fused polycyclic aromatic hydrocarbons, phthalocyanine, flavanthrone, crown ethers and salts thereof, including the products of polymeric or monomeric oxygen- or sulfur-based crown ethers with quaternary amine compounds, lithium hydrazinium sulfate, carbonaceous particles, and ferrites.

Certain of the above-mentioned solid particles are customarily available in a form in which a certain amount of water or other low molecular weight polar material is present, which is discussed in greater detail below. This is particularly true for polar organic particles such as cellulose or ionic polymers. These liquid polar materials need not necessarily be removed from the particles, but they are not necessarily required for the functioning of the present invention.

Certain of the above-mentioned solid particles exhibit a measure of conductivity or semiconductivity. While a degree of conductivity is often associated with the presence of electrorheological activity, the two phenomena are not coextensive. In particular, materials with unusually high conductivity are not preferred for use as particles, because ER fluids prepared therefrom may consume an unacceptable amount of current in order to maintain an electrical field and ER activity. Accordingly, the solid particles should have a conductivity at room temperature of at most $10^{-4}$ S/cm ($10^{-4}$ $\Omega^{-1}cm^{-1}$), preferably at most $10^{-5}$ S/cm, and more preferably at most $10^{-7}$ S/cm. This conductivity is measured as described in detail in ASTM D-4496-85, a standard for measuring dc resistance or conductance of moderately conductive materials, that is those having a volume resistivity between 1 and $10^{7}$ Ω-cm (or a conductivity between 1 and $10^{-7}$ S/cm). ASTM D-4496 further refers to ASTM D-257 for specific details of electrode systems, test specimens, and measurement techniques.

The particles used as this portion of the ER fluids of the present invention can be in the form of powders, fibers, spheres, rods, core-shell structures, agglomerated particles, etc. The size of the particles of the present invention is not particularly critical, but generally particles having a number average size of 0.25 to 100 μm, and preferably 1 to 20 μm, are suitable. The maximum size of the particles would depend in part on the dimensions of the electrorheological device in which they are intended to be used, i.e., the largest particles should normally be no larger than the gap between the electrode elements in the ER device.

The particles, moreover, can be coated, if desired, with materials to affect their surface area or surface affinity. Coating can be particularly desirable on particles of cellulose. The thickness of any coating will, of course, contribute somewhat to the overall size of the particles and should be appropriately taken into account.

The electrorheological fluids of the present invention further include a low molecular weight polar activating material, sometimes referred to as an activator. This low molecular weight polar material is a material other than any of the aforementioned components. These materials are referred to as polar compounds in that they generally have a dielectric constant of greater than 5. They are also commonly relatively low molecular weight materials, having a molecular weight of 450 or less, preferably 230 or less.

Certain ER-active particles, such as cellulose or polymeric salts, commonly have a certain amount of water associated with them. This water can be considered to be one type of polar activating material. The amount of water present in the compositions of the present invention can be 0.1 to 30 percent by weight, based on the solid particles, although extensive drying can result in lower water contents, and indeed water as such is not believed to be required for the functioning of this invention. The polar activating material can be introduced to the ER fluid as a component of the solid particles (such as absorbed water), or it can be separately added to the fluid upon mixing of the components. Whether the polar activating material remains dispersed through the bulk of the ER fluid or whether it associates with the particle phase is not precisely known in every case, and such knowledge is not essential to the functioning of the present invention. However, it is believed that a portion of the activating material will be associated with the solid polymer component, described in detail below. It is preferred that under some conditions a portion of the activating material is associated with (sorbed by) the solid component (d) in preference to association with the electrorheologically active particles. This association will be a function of temperature, as described in greater detail below.

Suitable polar activating materials can include water, amines, amides, nitrites, alcohols, polyhydroxy compounds, low molecular weight esters, and ketones. Suitable polyhydroxy include ethylene glycol, glycerol, 1,2-propanediol, 1,3-propanediol, 1,4-butanediol, 1,5-pentanediol, 2,5-hexanediol, 2-ethoxyethanol, 2-(2-ethoxyethoxy)ethanol, 2-(2-butoxyethoxy)ethanol, 2-(2-methoxyethoxy)ethanol, 2-methoxyethanol, and 2-(2-hexyloxyethoxy)ethanol. Suitable amines include ethanolamine and ethylenediamine. Other suitable materials are carboxylic acids such as formic acid and trichloroacetic acid. Also included are such aprotic polar materials as dimethylformamide, dimethylsulfoxide, propionitrile, nitroethane, ethylene carbonate, propylene carbonate, pentanedione, furfuraldehyde, sulfolane, diethyl phthalate, and the like. Low molecular weight esters include materials such as ethyl acetate; these materials are distinguished from other esters, which are less polar materials having a dielectric constant less than 5 and with molecular weights commonly greater than 230, preferably greater than 450, which can be used as the inert medium.

While a portion of the polar material is believed to be normally physically adsorbed or absorbed by the solid particle phase, and a portion is also associated with the solid polymer, described below, it is also possible to chemically react a portion of the polar material with the particle component. This can be done, for example, by condensation of alcohol or amine functionality of certain polar materials with an acid or anhydride functionality on the electrorheologically active particle or its precursor. Such treatment would normally be effected before any coating material is applied to the particles.

A fourth component of the present invention is a solid polymer, distinct from the particles of (b), insoluble in the hydrophobic medium and in the low molecular weight polar activating material, containing hydrophilic functionality. The polymer is one in which at least a portion of the low molecular weight polar activating material is capable of being sorbed (adsorbed or absorbed) in an amount which increases with increasing temperature. "Insoluble" means the polymer does not dissolve, that is, become molecularly dispersed in either the hydrophobic medium or in the low molecular weight polar activating material, especially when they are combined to form the electrorheological fluid system of the present invention. There may in some cases be a solution-like interaction between the polymer chains and the polar activator substance, but the polymer in the present system (because of crosslinking or some other mechanism) will remain intact substantially as a solid.

This solid polymer, moreover, is selected in combination with the chemical nature of the hydrophobic liquid medium, such that the polymer is preferably not swelled by the hydrophobic liquid medium under conditions of use.

The sorption of the low molecular weight polar activating material in the solid polymer is at least partially reversible. This characteristic can be determined experimentally by immersing a sample of the polymer in the polar activating material and measuring the increase in weight of the sample as the polar activating materials is sorbed. The reversibility of this sorption means that, as the temperature increases above a certain point, a greater amount of the polar material is sorbed; when the temperature is thereafter reduced, at least a portion of the polar activating material is desorbed. (A portion of the polar material may in some cases become more or less irreversibly associated with the polymer upon initial contact.) Similar behavior is preferably also exhibited in the environment of an electrorheological fluid system. However, in such systems the concentration of the polar activating material is generally significantly less than in the above-described test, so that the phenomenon is experimentally more difficult to observe. The solid polymer component thus includes those materials generally known as phase transition materials or phase-change gels. These are polymeric materials which do not dissolve in the polar activating material but which, due to their hydrophilic functionality, do interact with the polar material, typically by adsorbing or absorbing ("sorbing") the material, often thereby swelling. This combination of interaction yet insolubility is typically effected by employing a crosslinked polymer, which, due to its high molecular weight, is insoluble yet retains the functionality which leads to strong interaction. This result can be obtained by other means as well, such as by employing an insoluble polymeric trunk with branches containing the hydrophilic functionality.

The degree of sorption by a given polymer as a function of temperature is in many cases not a smooth function, but rather a discontinuous, sudden, or step function. That is, there is frequently a sharp transition temperature below which little or no sorption, and specifically absorption, occurs and above which maximum absorption occurs. Such materials are sometimes referred to as upper critical solution temperature (UCST) materials. If it is desired that the degree of absorption vary gradually with temperature, this can be effected by employing a mixture of two or more such polymers, with progressive higher transition temperatures, or by use of a copolymer which incorporates different functional moieties, serving to broaden the transition temperature.

The phenomena relating to changes in polymer solubility as function of temperature have been extensively explored. Further information on this subject can be obtained by consulting *Polymer Handbook*, third edition, 1989, J. Brandrup and E. H. Immergut, John Wiley & Sons, referring specifically to the chapter "Theta Solvents," Section VII, pages 205–231, where the theta temperatures for a number of large polymer/solvent systems is reported. The theta temperature is the temperature at which the affinity of a polymer for itself is the same as its affinity for the solvent in question; it is a measure of the transition between soluble and insoluble behavior of the polymer.

A variety of phase transition materials designed for various purposes are well known in the literature and have been extensively investigated. Among these materials are various polyacrylates, cellulose ethers, hydroxyethyl methacrylate polymers, hyaluronic acid, chitosan, DNA, gelatin, and agarose. Other hydrophilic polymeric materials which, under suitable conditions such as crosslinking, can be treated to be made insoluble, include poly(ethylene glycol)-containing polymers, poly(acrylic acid), maleic anhydride copolymers, vinyl acetate/vinyl alcohol copolymers, and polyvinyl alcohol.

Of particular interest for the present invention are polymers which comprise polyalkylene oxide groups, and in particular, polyethylene oxide groups. These groups can comprise both homopolymer chains and copolymer chains, for instance, copolymers of ethylene oxide with other alkylene oxides such as propylene oxide, butylene oxide, and the like. The polyalkylene oxide groups will preferably have a number average molecular weight of at least 1000. The polyalkylene oxide groups, which normally would exhibit solubility in many polar liquids, is made insoluble by e.g. grafting it onto an insoluble polymer backbone or, preferably, by effecting crosslinking of the polymer.

Crosslinking can be effected by any known crosslinking agents or monomers, including reactive polyfunctional agents, such as polyisocyanates to form urethane linkages from polymers or monomers having hydroxy functionality; polycarboxylic acids to form ester linkages; or activated polyolefins. Acid-containing polymers can be crosslinked by introduction of di- or trivalent metal ions. Polyalkylene oxides can be crosslinked by polymerization or copolymerization of the alkylene oxide monomers in the presence of a cross-linking agent. For example, alkylene oxide polymerization can be initiated with a tri- or polyfunctional molecule (such as trimethylolpropane or pentaerythritol), followed by completing the polyether formation, and then capping or crosslinking with a small amount of a di or polyfunctional agent such as an isocyanate. Alternatively, low level of an already-coupled monomer can be included with the simple monomer during the polymerization reaction. In another approach, a linear polymer such as poly(ethylene glycol) can be prepared, followed by capping the polymer by reacting it with a tri or polyfunctional crosslinking agent such as a polyisocyanate. In yet other approaches, polymers can be treated with radical generating agents. For more information on methods for crosslinking of polymers, attention is directed to the *Encyclopedia of Polymer Science and Engineering* (second edition, 1986), John Wiley & Sons, volume 4, pages 350–395. For more information on gels, their properties, and their preparation, attention is directed to the same reference, volume 7, pages 514–531.

EXAMPLE 1

Into a 500 mL flask is added 53.6 g of CC31™ cellulose (from Whatman), 9.5 g of poly(ethylene glycol) ($M_n$ 1000) dimethacrylate and 0.5 g poly(ethylene glycol) ($M_n$ 1000) monomethylether monomethacrylate (from Polysciences, Inc.) as well as 200 g toluene. To the mixture at 80° C. is added 0.25 g of Perkadox™ N16 initiator (from Akzo), dissolved in 30 g toluene, over 30 minutes. The reaction is stirred at 95° C. under nitrogen for 18 h. The solid contents are removed by filtration, then dried under vacuum at room temperature then at 120° C. at 170 Pa (0.05 inch Hg) for 18 hours.

EXAMPLE 2

Into a 1000 mL flask is added 150 g of CC31™ cellulose and 600 g cyclohexane. The mixture is heated to 70° C. under nitrogen. A solution of 0.75 g of poly(ethylene glycol) ($M_n$ 1000) dimethacrylate and 6.75 g poly(ethylene glycol) ($M_n$ 1000) monomethylether monomethacrylate in 41.4 g water is added dropwise. A solution containing 0.38 g of V-50™ initiator (from Wako) in 8.8 g water is added dropwise. The mixture is stirred for 18 hours. The solid contents are removed by filtration then dried at 75° C. at 170 Pa (0.05 inch Hg) for 18 hours.

EXAMPLE 3

Into 22.22 g water is dissolved 2.22 g of poly(ethylene glycol) ($M_n$ 1000) dimethacrylate and 20 g poly(ethylene glycol) ($M_n$1000) monomethylether monomethacrylate. The solution is sparged with nitrogen and 0.44 g of V-50™ initiator is dissolved therein. The solution is placed into a vacuum oven and degassed by subjection to a pressure of 41 kPa (12 inch Hg). The oven is then back filled with nitrogen and the solution is poured into a petri dish. The oven is slowly purged with nitrogen and heated to 60° C. After 18 hours the pressure is reduced to 170 Pa (0.05 inch Hg) and held for 2 days to remove the water.

EXAMPLE 4

Into a 1000 mL flask is added 620 g cyclohexane and 30 g fumed silica (from DeGussa, TS100™). The mixture is stirred under nitrogen. A solution containing 22.6 g water, 0.14 g V-50™ initiator, 22.22 g poly(ethylene glycol) ($M_n$ 400) monomethacrylate (from Polysciences), and 2.22 g poly(ethylene glycol) ($M_n$ 600) dimethacrylate (from Sartomer) is added dropwise over 10 minutes followed by the addition of 1.84 g of water over 8 minutes. The mixture is stirred for 20 minutes. The temperature is raised to 65° C. and held for 16 hours. The solid is recovered by filtration and washed with cyclohexane. The material is dried at 120° C. at 170 Pa (0.05 inch Hg).

EXAMPLE 5

Into a 500 mL flask is added 100.0 g poly(ethylene glycol), number average molecular weight 4600 (equivalent weight 2300) and about 200 g HPLC-grade toluene. The mixture is sparged with nitrogen at 28 L/hr (1.0 std. $ft^3$/hr) and heated to reflux. The nitrogen flow is reduced to 3 L/hr (0.1 std. $ft^3$/hr) and about 100 g toluene is removed by distillation. The temperature is reduced to 90° C. and, over 10 minutes, 8.3 g poly(hexamethylene diisocyanate), Desmodur™ N-100 (obtained from Aldrich), dissolved in 20 g toluene, is added. The resulting solution is poured into pans and allowed to cure for three hours in an oven at 90° C. under nitrogen. The remaining toluene is removed at 70° C. at 130 Pa (1 mm Hg).

EXAMPLE 6

Into a 500 mL flask is added 200 g toluene and 100 g poly(ethylene glycol) (from Aldrich). The flask is heated to 110° C. under a nitrogen purge and 100 g of toluene are removed by distillation. The solution is cooled to 90° C. and 0.32 g of glycerol (99+%, from Aldrich) is added followed by 6.35 g of poly(hexamethylene diisocyanate) (Desmodur™ N-100) dissolved into 25 g toluene. The solution is stirred for 5 minutes then poured into pans. The pans are placed into an oven at 90° C. under nitrogen and held for 10 hours. The solvent is removed by heating the material to 75° C. at 170 Pa (0.05 inch Hg) for 18 hours.

EXAMPLE 7

Into a 500 mL flask is added 100 g toluene and 57.5 g poly(ethylene glycol). The flask is heated to 110° C. under a nitrogen purge and 50 g of toluene are removed by distillation. The solution is cooled to 90° C. and 0.767 g of glycerol is added followed by 9.55 g of poly(hexamethylene diisocyanate) (Desmodur™ N-100) dissolved into 10 g toluene. The solution is stirred for 5 minutes then poured into pans. The pans are placed into an oven at 90° C. under nitrogen and held for 10 hours. The solvent is removed by heating the material to 75° C. at 170 Pa (0.05 inch Hg) for 18 hours.

The solid polymer of this component of the invention has the characteristic, as described above, that the polar activating material is sorbed therein in an amount which increases with increasing temperature, and this sorption is at least in part reversible. The total volume of polar material which can be sorbed can vary as a function of the properties of the polymer and its method of synthesis. For example, incorporating more cross linking in the polymer will normally decrease the total amount of polar material which can be sorbed. It is also believed that changing the polymeric architecture (cross link density, number of un-capped chains) or the surface to volume ratio of the particles may affect the speed of sorption/desorption from the particles. These variables can be adjusted as necessary by the person skilled in the art. Moreover, not every low molecular weight polar activating material will exhibit the behavior in combination with every otherwise suitable solid polymer. Appropriate combinations can readily be determined by the person skilled in the art by the simple experimental test described above.

For the present invention, combinations of poly(ethylene glycol) with alcohols such as ethylene glycol are particularly favored. In such systems the partitioning of ethylene glycol among the various components of the system changes with temperature. The amount of the ethylene glycol associated with the dispersed particulate phase is thus believed to decrease at elevated temperatures as the amount associcated with the solid polymer increases. (The total amount of ethylene glycol in the system normally remains constant.) This is a highly desirable result, since electrorheological systems which contain a relatively fixed and constant amount of polar activator associated with the dispersed particulate phase often exhibit excessive conductivity at high temperatures and insufficient activity at low temperatures. By employing the materials of the present invention, a larger overall amount of polar activator can be employed, to improve low-temperature activity, while the excessive conductivity at high temperatures which would otherwise result is minimized. Hence the useful temperature range of the electrorheological system can be increased.

The physical form of the solid polymer in which the activator is sorbed is not critical, so long as there is sufficient contact between the polymer and the bulk of the electrorheological fluid that a reasonable rate of transfer or equilibrium can be established between the activator sorbed in the polymer and that in the bulk of the fluid or on the ER-active particle. The actual mechanism of transfer of the activator from the polymer to the ER-active particle is not well understood and is not believed to be particularly important to the functioning of the invention. Transfer could occur by trace solubility of the activator in the liquid medium, by formation of dispersed droplets of the polar in the base fluid, or by direct contact of the dispersed particulate phase with the polymer phase. As an example, if the solid polymer in which the activator is sorbed is in the form of a fine powder, similar in dimensions to that of the dispersed particulate phase, intimate mixing and transfer of activator can be easily attained. Similarly, if the polymer is present as a coating on the particles of the dispersed phase, it is expected that excellent transfer would occur. However, there may at times be disadvantages of such a configurations. It is not apparent that fine particles of the solid polymer will necessarily themselves always function as a satisfactory electrorheological solid. That is, if the powdered polymer is permitted to pass between the electrodes of an ER device, along with the dispersed particulate phase, the overall ER performance may be degraded. The polymer particles, loaded with polar activator material, may, for instance, themselves contribute significant undesired conductivity to the fluid in the electrode gap. Alternatively, if the polymer particles exhibit no electrorheological activity, they may serve to reduce the overall ER activity, by dilution, to an undesirable extent. Thus in some cases a different configuration may be desired.

In any event, the solid polymer of the present invention is described as "distinct" from the particles of the dispersed particulate phase. By this expression it is meant that the solid polymer is not identical to the particles of the dispersed particulate phase; that is, the solid polymer and the particles of the particulate phase can be separately identified and are neither one and the same chemically nor are they intermixed on a molecular scale. Thus, physical mixtures of particles as well as coatings of one material on particles of another are encompassed by the term "distinct." However, in a preferred embodiment the two components are by and large not so intermixed. The solid polymer material is preferably present in a form in which it will not accompany the other components of the ER system in their passage between the electrodes of an electrorheological device. This can be accomplished, for example, by providing the solid polymer in the form of particles or pieces of a physical size larger than will pass through the electrode gap. Alternatively, in order to avoid possible problems with plugging of the electrode gap, such larger particles or pieces can be restrained by other mechanical means from contact with the electrodes. For example, relatively large pieces can be contained within a chamber in the ER device which is removed from the electrodes, yet which is open to circulation of the ER fluid. Other embodiments are possible; for example, the solid polymer can be coated on an inert substrate (ceramic, polymeric, metallic, etc.) for support and can have the final form of particles, pieces, inserts, sheets, machined parts, and the like.

EXAMPLE 8

The material of example 4 is cut into disks with an approximate diameter of 25 mm (1 inch) and a thickness of approximately 0.8 mm (1/32 inch). The disks are soaked in approximately 50 times their weight of osmotically purified water for 24 hours; then the water is decanted. These washing are repeated three times. The material is dried at 70° C. at 170 Pa (0.05 inch Hg).

EXAMPLE 9

The material of example 4 is soaked in approximately 50 times its weight of osmotically purified water for 24 hr then cut into needles. The dimensions are approximately 0.4 mm×0.4 mm×6 mm (1/64×1/64×1/4 inch). The needles are soaked in approximately 50 times their weight of osmotically purified water for 24 hours; then the water is decanted. These washings are repeated three times. The material is dried at 70° C. at 170 Pa (0.05 inch Hg).

EXAMPLE 10

The material of example 4 is soaked in approximately 50 times its weight of osmotically purified water for 24 hr then placed into a Waring™ blender. The material is blended on high speed for approximately 5 minutes. The water is decanted from the mixture and replaced with fresh water. The material is allowed to soak for 24 hours. The solid is recovered by filtration. The material is dried at 70° C. at 170 Pa (0.05 inch Hg).

The figures illustrate two embodiments by which the polymer can be incorporated into an electrorheological device. FIG. 1 represents a damper of the hydraulic piston and cylinder type, having a hydraulic cylinder 28 enclosing a piston 30. A piston rod 32 is connected to the piston 30 and is secured to the an upper load by means of a suitable connector. The cylinder 28 is likewise secured to a lower base by a suitable connector. Relative vertical motion between the load and the base causes relative movement between the cylinder 28 and the piston 30. The relative movement between cylinder 28 and piston 30 displaces an electrorheological fluid (not separately shown) between the upper and lower variable volume fluid chambers 38 and 40 of the cylinder 28 via a flow paths 41 and 42. The flow path 42 can be rapidly adjusted by electrical means, to alter the force required to cause movement in either an extending or retracting direction between the cylinder 28 and the piston 30. A means, such as floating piston 43, can be provided to allow for expansion and displacement of the fluid. The damper is preferably of the continuous force-controlled type such as that disclosed in Petek et al., "Demonstration of an Automotive Semi-active Suspension Using Electrorheological Fluid", SAE Paper No. 950586, February 1995, and as further disclosed in U.S. Pat. No. 5,259,487, to which attention is directed for further details.

In the damper of FIG. 1, 78 represents an electrical lead supplying a voltage to cylindrical electrode member 80. The outer body of the cylinder 28 represents the other electrode and is considered to be grounded to, e.g., the chassis of an automobile or other equipment. The electrorheological fluid will flow between the members 28 and 80 in response to application of voltage through the electrical lead 78, and the apparent viscosity of the fluid will vary with the applied electrical field, thereby altering the damping characteristics of the device.

In FIG. 1, the insoluble polymer is illustrated as granules 81 housed within a chamber located behind screening element 82. The granules are of a size which will not pass through the mesh of the screen, although the remainder of the ER fluid, that is, the hydrophobic liquid, the polar activating material, and optionally also the dispersed particulate phase, can pass through the mesh. In this way contact and exchange of activator material between the components of the system can be effected.

Figure 2:
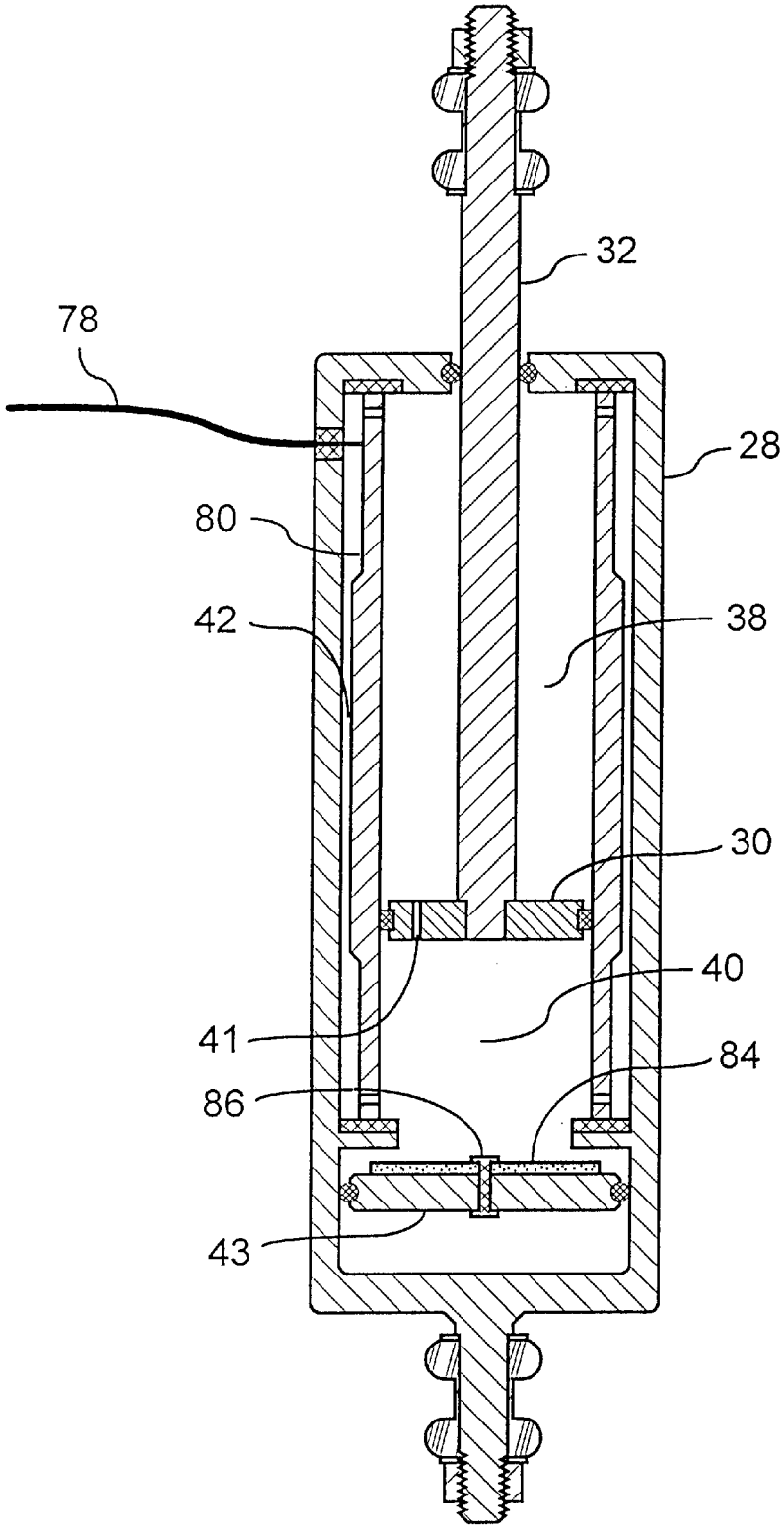
FIG. 2 illustrates an alternative embodiment of the system of the present invention.

In FIG. 2, the insoluble polymer is illustrated as an insert 84, which is affixed by mechanical restraints (such as clips, wires, springs, rivets, screws or, as illustrated, a bolt 86 of, e.g., nylon) to a structural element in a chamber away from the electrodes. Retaining washers (of, e.g., Teflon™ polymer) and other retaining elements, not shown, may also be present.

The types of possible mechanical arrangements possible are by no means limited to those illustrated. For example, the polymer can also be present as thin sheets, to provide a larger surface area, which are appropriately affixed.

The ER fluid may also contain other typical additives which are commonly employed in such materials, including antioxidants, antiwear agents, and dispersants. Surfactants or dispersants are often desirable to aid in the dispersion of the particles and to minimize or prevent their settling during periods of non-use. It is speculated that such materials may also aid the transport of liquid polar activator material into and out of the solid polar material and to and from the dispersed particulate phase. They can also be employed to modify the transition temperature of the solid polar material, so that it will absorb or desorb the low molecular weight activator at a different temperature.

Dispersants are known and can be designed to complement the properties of the hydrophobic fluid. For example, functionalized silicone dispersants or surfactants may be the most suitable for use in a silicone fluid, while hydroxyl-containing hydrocarbon-based dispersants or surfactants may be the most suitable for use in a hydrocarbon fluid. Functionalized silicone dispersants are described in detail in PCT publication WO93/14180, published Jul. 22, 1993, and include e.g. hydroxypropyl silicones, aminopropyl silicones, mercaptopropyl silicones, and silicone quaternary acetates. Other dispersants include acidic dispersants, ethoxylated nonylphenol, sorbitan monooleate, glycerol monooleate, basic dispersants, sorbitan sesquioleate, ethoxylated coco amide, oleic acid, t-dodecyl mercaptan, modified polyester dispersants, ester, amide, or mixed ester-amide dispersants based on polyisobutenyl succinic anhydride, dispersants based on polyisobutyl phenol, ABA type block copolymer nonionic dispersants, acrylic graft copolymers, octylphenoxypolyethoxyethanol, nonylphenoxypolyethoxyethanol, alkyl aryl ethers, alkyl aryl polyethers, amine polyglycol condensates, modified polyethoxy adducts, modified terminated alkyl aryl ethers, modified polyethoxylated straight chain alcohols, terminated ethoxylates of linear primary alcohols, high molecular weight tertiary amines such as 1-hydroxyethyl-2-alkyl imidazolines, oxazolines, perfluoralkyl sulfonates, sorbitan fatty acid esters, polyethylene glycol esters, aliphatic and aromatic phosphate esters, alkyl and aryl sulfonic acids and salts, tertiary amines, and hydrocarbyl-substituted aromatic hydroxy compounds, such as $C_{24-28}$ alkyl phenols, polyisobutenyl ($M_n$ 940) substituted phenols, propylene tetramer substituted phenols, polypropylene ($M_n$ 500) substituted phenols, and formaldehyde-coupled substituted phenols. Moreover, the base fluid can be a mixture of fluids of different solubility characteristics. Thus a fluid comprising primarily a silicone material could include a small amount of a polyether fluid, which may provide improved transport of the polar material.

The amounts of materials within the present electrorheological system are not critical and can be adjusted by the person skilled in the art to obtain the optimum electrorheological properties. At a minimum, the relative amounts of the components of the present inventions are such that the composition exhibits electrorheological activity, and that that activity is beneficially modified by the presence of the solid insoluble polymer in which the activator is sorbed.

A standard formulation and test for ER activity is described in PCT publication WO93/22409, published Nov. 11, 1993. The material to be tested is supplied as a powder, preferably having a particle size such that it will pass through a 710 $\mu$m mesh screen. The particles are thoroughly dried, for instance by heating for several hours in a vacuum oven at 110 to 150° C., preferably about 120° C. The dried particles are compounded into a fluid for electrorheological testing by combining on a ball mill 25 g of the particles with 96.35 g of a 10 cSt silicone base fluid and 3.75 g of a functionalized silicone dispersant (EXP 69™) for 24 hours.

An appropriate amount of water or other low molecular weight polar activator material is added. The fluid can be tested in an oscillating duct flow device. This device pumps the fluid back and forth through parallel plate electrodes, with a mechanical amplitude of flow of ±1 mm and an electrode gap of 1 mm. A useful mechanical frequency for evaluation is 16–17 Hz. (These conditions provide a maximum shear during the cycle of approximately 20,000 $sec^{-1}$.) The electrorheological activity can be evaluated by comparing the properties of the fluid at 20° C. under a 6 kV/mm field with the properties in the absence of applied field. It is to be understood that the field strength, concentrations of materials, or mechanical design of the test device can be modified as necessary to suit the particular fluid, as will be apparent to the person skilled in the art. The presence of electrorheological activity can be concluded when the shear stress in the presence of the field is not substantially identical to that in the absence of field. "Substantially identical" can be interpreted to mean an increase in the shear stress of less than 20% or preferably less than 10%.

A more complete evaluation of electrorheological activity can be made by considering the steady-state Winslow number, Wn, measured at a constant field after the fluid has reached a (constant) maximum strength:

$$Wn = \frac{(YS)^2}{(PD)(\eta_0)}$$

$YS$ = Yield stress (Pa) under field $PD$ = Power density ($w/m^3$) at steady state = Current density × Field strength $\eta_0$ = Viscosity with no field applied (PaS)

Alternatively, for some applications the "millisecond Winslow number," Wn' is more useful:

$$Wn' = \frac{(\Delta SS)^2}{(PD)(\eta_0)}$$

where PD and $\eta_0$ are defined as above and ASS is the shear stress increase at 5 ms when field is applied. This measurement is made using a 5 Hz oscillation (about 6000 $s^{-1}$); the shear stress 5 milliseconds after application of a field (normally 6 kV/mm) is measured, and the shear stress in the absence of field is subtracted therefrom. A higher value for Wn or Wn' indicates better ER performance overall.

The amount of the hydrophobic base fluid employed in the present invention is normally the amount required to make up 100% of the fluid composition after the other ingredients of the fluid are accounted for. Often the amount of the base fluid is 10–94.9 percent of the total fluid composition, preferably 36–89 percent, and most preferably 56–79 percent. These amounts are normally percent by weight, but if an unusually dense dispersed solid phase is used, it may be more appropriate to determine these and the other amounts reported herein amounts as percent by volume. The amounts presented, unless otherwise indicated, are based on the amount of the fluid exclusive of the solid insoluble polymer component in which the activator is sorbed.

Similarly, the amount of the dispersed particulate phase in the ER fluid should be sufficient to provide a useful electrorheological effect at reasonable applied electric fields. However, the amount of particles should not be so high as to make the fluid too viscous for handling in the absence of an applied field. These limits will vary with the application at hand: an electrorheologically active grease, for instance, would desirably have a higher viscosity in the absence of an electric field than would a fluid designed for use in e.g. a valve or clutch. Furthermore, the amount of particles in the fluid may be limited by the degree of electrical conductivity which can be tolerated by a particular device, since the particles normally impart at least a slight degree of conductivity to the total composition. For most practical applications the particles will comprise 1 to 80 percent by weight of the ER fluid, preferably 5 to 60 percent by weight, more preferably 5 or 10 to 50 percent by weight, and most preferably 15 to 35 percent by weight. (These percentages are based on the fluid components (a), (b), and (c), that is, excluding from the calculation component (d), the solid polymer which sorbs the activator. The amount of further optional additives is normally relatively small and can be ignored in this calculation.) Other combinations of these upper and lower weight limits are also contemplated. Of course if the nonconductive hydrophobic fluid is a particularly dense material such as carbon tetrachloride or certain chlorofluorocarbons, these and other weight percentages could be adjusted to take into account the density. Determination of such an adjustment would be within the abilities of one skilled in the art.

The amount of the low molecular weight polar activating material is preferably 0.5 to 25 percent by weight of the fluid composition ((a)+(b)+(c)), preferably 1 to 15 percent, and more preferably 2 or 3 to 8 or 5 percent. Alternatively, the amount of polar activating material can be expressed as an amount of the solid polymeric material in which it is in part sorbed. Thus expressed, the amount of the activator can vary widely, depending on gel synthesis, cross link density, and void volume, and on the final application. Amounts are typically 5 to 200 percent, preferably 10 to 80 percent, more preferably 10 to 50 percent or 20 to 40 percent.

The amount of the optional surfactant or dispersant component in the present invention is an amount sufficient to improve the dispersive stability of the composition. Normally the effective amount will be 0.1 to 20 percent by weight of the fluid, preferably 0.4 to 10 percent by weight of the fluid, and most preferably 1 to 5 percent by weight of the fluid.

The amount of the solid polymeric material in which the activator is sorbed is likewise variable over a wide range. Typically this polymer is present in an amount of 1 to 100 percent by weight, based on the total electrorheological fluid (i.e., the liquid medium, the dispersed particulate phase, the low molecular weight activator, and any other additives). Preferably it is present in an amount of 5 to 50 percent or 10 to 25 percent.

The ER fluids of the present invention find use in clutches, valves, dampers, torque transfer devices, positioning equipment, and the like, where it is desirable to vary the apparent viscosity of the fluid in response to an external signal. Such devices can be used, for example, to provide an automotive shock absorber which can be rapidly adjusted to meet the road conditions encountered during driving.

EXAMPLE 11

Into a ball mill jar containing 7 ceramic media is added 2.0 g of material from example 4, 30.0 g of CC31™ cellulose, 2.0 g $C_{24-28}$-alkyl phenol, 3.0 g ethylene glycol, and 63.0 g of Emery™ 2911 ester oil (from Henkel). The jar is rolled at approximately 80 rpm for 24 hours and the contents, minus the media, are recovered. Into an ER mini-duct flow testing device is added approximately 40 g of material and electrorheological activity is evaluated at various shear rates, temperatures, and electric fields.

EXAMPLE 12

Into a ball mill jar containing 7 ceramic media is added 30.0 g of dried CC31™ cellulose, 3.0 g of ethylene glycol, and 67.0 g of Emery 2911 ester oil. The jar is rolled at approximately 80 rpm for 24 hours and the contents, minus the media, are recovered. Into an ER mini-duct flow testing device is secured one 0.6 g disk from example 8 by means of a bolt inserted though a center hole. The device is filled with approximately 40 g of above-described blend and electrorheological activity is evaluated at various shear rates, temperatures, and electric fields.

EXAMPLE 13

Into a ball mill jar containing 7 ceramic media is added 30.0 g of dried CC31™ cellulose, 3.0 g of ethylene glycol, and 67.0 g of Emery™ 2911 ester oil. The jar is rolled at approximately 80 rpm for 24 hours and the contents, minus the media, are recovered. Into an ER mini-duct flow testing devise is secured a holder containing approximately 1 g of needles from example 9 by means of a bolt. The holder is a short polypropylene cylinder. The needles are retained by fiberglass screening adhered over the top of the cylinder. The device is filled with approximately 40 g of above-described blend and electrorheological activity is evaluated at various shear rates, temperatures, and electric fields.

EXAMPLE 14

Into a ball mill jar containing 7 ceramic media is added 7.5 g of material from example 10, 45.0 g of dried CC31™ cellulose, 5.25 g of ethylene glycol, and 95.25 g of Emery™ 2911 ester oil. The jar is rolled at approximately 80 rpm for 24 hours and the contents, minus the media, are recovered. Into an ER mini-duct flow testing device is added approximately 40 g of the blend and electrorheological activity is evaluated at various shear rates, temperatures, and electric fields.

EXAMPLE 15

Into a 500 mL flask is added 300 g toluene, 70 g n-butylmethacrylate, and 5 g of ethylene glycol dimethacrylate (both from Aldrich). The solution is heated to 50° C. under nitrogen and a solution of 0.8 g of Perkadox™ N16 initiator (from Akzo), dissolved in 20 g toluene, is added dropwise over 5 minutes. The solution is poured onto flat pans and cured in an 80° C. oven under nitrogen for 10 hours. The solvent is removed by reduced pressure, 17 Pa, at 80° C. The resulting material is cut into flat disks approximately 25 mm in diameter and 0.8 mm thick.

EXAMPLE 16

Into a 500 mL flask is added 300 g toluene, 70 g methylmethacrylate, and 5 g of ethylene glycol dimethacrylate (both from Aldrich). The solution is heated to 50° C. under nitrogen and a solution of 0.8 g of Perkadox™ N16 initiator (from Akzo), dissolved in 20 g toluene, is added dropwise over 5 minutes. The solution is poured onto flat pans and cured in an 80° C. over under nitrogen for 10 hours. The solvent is removed by reduced pressure, 17 Pa, at 80° C. The resulting material is cut into flat disks approximately 25 mm in diameter and 0.8 mm thick.

EXAMPLE 17

Example 12 is repeated except that the ethylene glycol is replaced with isopropanol and the disk from Example 8 is replaced by one disk from Example 15 and one disk from Example 16, mounted together.

Each of the documents referred to above is incorporated herein by reference. Except in the Examples, or where otherwise explicitly indicated, all numerical quantities in this description specifying amounts of materials, reaction conditions, molecular weights, number of carbon atoms, and the like, are to be understood as modified by the word "about." Unless otherwise indicated, each chemical or composition referred to herein should be interpreted as being a commercial grade material which may contain the isomers, by-products, derivatives, and other such materials which are normally understood to be present in the commercial grade. However, the amount of each chemical component is presented exclusive of any solvent or diluent oil which may be customarily present in the commercial material, unless otherwise indicated. As used herein, the expression "consisting essentially of" permits the inclusion of substances which do not materially affect the basic and novel characteristics of the composition under consideration.

What is claimed is:

1. An electrorheological fluid system suitable for use in an electrorheological device which comprises a fluid compartment which contains a portion of said fluid system and a pair of electrodes separated by a gap and encompassing a portion of said fluid system, said fluid system comprising:

(a) a hydrophobic liquid medium having a boiling point of at least about 150° C.;

(b) a dispersed particulate phase comprising an effective amount of electrorheologically active particles to exhibit electrorheological activity in the presence of an activating material;

(c) an effective amount of a low molecular weight polar activating material to modify the electrorheological activity of said dispersed particulate phase; and (d) an effective amount of a solid polymer to reduce the increase in conductivity of said electrorheological fluid system at elevated temperatures, said polymer being distinct from the particles of (b), insoluble in said low molecular weight activating material and in said hydrophobic medium, containing hydrophilic functionality, and capable of sorbing an amount of said low molecular weight polar activating material which increases with increasing temperature, said sorption being at least in part reversible;

wherein the polymer of (d) is in a form of one or more pieces other than particles of a dispersed particulate phase, whereby said fluid can be employed between the electrodes of said electrorheological device without passage of the pieces of polymer of (d) between said electrodes.

2. The electrorheological fluid system of claim 1 wherein the pieces of the polymer of (d) are in the form of one or more inserts which can be employed in fluid chambers of such an electrorheological device outside the gap between said electrodes.

3. The electrorheological fluid system of claim 1 wherein the particles of the dispersed particulate phase are capable of exhibiting substantial electrorheological activity only in the presence of an activating material.

4. The electrorheological fluid system of claim 1 wherein the particles of the dispersed particulate phase comprise a cellulosic material.

5. The electrorheological fluid system of claim 4 wherein the cellulosic material comprises cellulose.

6. The electrorheological fluid system of claim 1 wherein said low molecular weight polar activating material has a molecular weight of about 230 or less.

7. The electrorheological fluid system of claim 1 wherein said low molecular weight polar activating material is ethylene glycol.

8. The electrorheological fluid system of claim 1 wherein the hydrophilic functionality of the polymer of component (d) comprises polyalkylene oxide groups.

9. The electrorheological fluid system of claim 8 wherein said polyalkylene oxide is polyethylene oxide.

10. The electrorheological fluid system of claim 9 wherein said polyethylene oxide comprises chains of at least about 1000 number average molecular weight.

11. The electrorheological fluid system of claim 1 wherein the polymer of component (d) is a crosslinked polymer.

12. The electrorheological fluid system of claim 11 wherein said crosslinked polymer comprises urethane linkages.

13. The electrorheological fluid system of claim 1 wherein the amount of the dispersed particulate phase is about 5 to about 50 percent by weight of the total of components (a), (b), and (c).

14. The electrorheological fluid system of claim 1 wherein the amount of the low molecular weight polar activating material is about 1 to about 15 percent by weight of the total of components (a), (b), and (c).

15. The electrorheological fluid system of claim 1 wherein the amount of the low molecular weight activating material is about 10 to about 50 percent by weight of component (d).

16. The electrorheological fluid system of claim 1 wherein the amount of the solid polymer of (d) is about b 1to about 100 percent by weight of the total of (a), (b), and (c).

17. The electrorheological fluid system of claim 1 further comprising (e) a surfactant.

18. An electrorheological device which comprises a fluid compartment which contains a portion of the fluid system of claim 1, a pair of electrodes encompassing a portion of said fluid system, and, contained within said fluid compartment, a means to retain said solid polymer of (d) separate from said electrodes.

19. A method for reducing the effect of temperature on the electrical properties of an electrorheological fluid, which fluid comprises (a) a hydrophobic liquid medium having a boiling point of at least about 150° C.;

(b) a dispersed particulate phase comprising an effective amount of electrorheologically active particles to exhibit electrorheological activity in the presence of an activating material;

(c) an effective amount of a low molecular weight polar activating material to modify the electrorheological activity of said dispersed particulate phase;

said method comprising including within said electrorheological fluid (d) an effective amount of a solid polymer to reduce the increase in conductivity of said electrorheological fluid at elevated temperatures, said polymer being distinct from the particles of (b), insoluble in said low molecular weight activating material and in said hydrophobic medium, containing hydrophilic functionality, and capable of sorbing an amount of said low molecular weight polar activating material which increases with increasing temperature, said sorption being at least in part reversible;

wherein the solid insoluble polymer is in a form of one or more pieces other than particles of a dispersed particulate phase, and wherein said fluid is employed between electrodes of an electrorheological device without passage of the solid insoluble polymer between said electrodes.

20. The method of claim 19 wherein the solid insoluble polymer is in the form of one or more inserts.

* * * * *